US008641472B2

(12) United States Patent
Taylor

(10) Patent No.: US 8,641,472 B2
(45) Date of Patent: Feb. 4, 2014

(54) TOY SNAKE

(75) Inventor: Graeme Taylor, Wolverhampton (GB)

(73) Assignee: China Industries Limited (GB)

( * ) Notice: Subject to any disclaimer, the term of this patent is extended or adjusted under 35 U.S.C. 154(b) by 0 days.

(21) Appl. No.: 13/145,971

(22) PCT Filed: Feb. 1, 2010

(86) PCT No.: PCT/GB2010/050156
§ 371 (c)(1),
(2), (4) Date: Jul. 22, 2011

(87) PCT Pub. No.: WO2010/086675
PCT Pub. Date: Aug. 5, 2010

(65) Prior Publication Data

US 2011/0287690 A1 Nov. 24, 2011

(30) Foreign Application Priority Data

Jan. 30, 2009 (GB) ..... 0901541.3
Aug. 21, 2009 (GB) ..... 0914656.4

(51) Int. Cl.
*A63H 3/00* (2006.01)

(52) U.S. Cl.
USPC ..... 446/368; 446/377; 446/396; 446/410

(58) Field of Classification Search
USPC ..... 446/368
See application file for complete search history.

(56) References Cited

U.S. PATENT DOCUMENTS

| | | | |
|---|---|---|---|
| 725,432 | A | 4/1903 | Flaherty |
| 857,593 | A | 6/1907 | Brown |
| 1,599,947 | A | 9/1926 | Bishop |
| 1,745,232 | A | 1/1930 | Richter |
| 2,035,308 | A | 3/1936 | Ferber |

(Continued)

FOREIGN PATENT DOCUMENTS

| | | | |
|---|---|---|---|
| WO | 2007130662 | A2 | 11/2007 |
| WO | 2010086675 | A1 | 8/2010 |

OTHER PUBLICATIONS

International Search Report and Written Opinion dated May 3, 2010 from PCT Application No. PCT/GB2010/050156 filed Feb. 1, 2010 (10 pages).

(Continued)

*Primary Examiner* — Tramar Harper
(74) *Attorney, Agent, or Firm* — Schmeiser, Olsen & Watts LLP

(57) ABSTRACT

A toy snake that reproduces the natural movement of a snake as it moves across surface is described. The toy snake comprises a head that is pivotally mounted to a tail and a motor unit located within the head. In a preferred embodiment a body is employed to pivotally mount the head to the tail. The motor unit comprises at least two independently driven wheels located towards opposite sides of the head and the motor unit is configured to introduce a periodic oscillation between the operation of the independently driven wheels. The motor unit may also be configured to operate a tongue that extends out from the head to further increase the realistic nature of the toy. Embodiments of the snake may be adapted for use on land or water.

15 Claims, 9 Drawing Sheets

(56) References Cited

U.S. PATENT DOCUMENTS

| | | | | |
|---|---|---|---|---|
| 2,194,537 | A * | 3/1940 | Adams | 446/353 |
| 2,241,576 | A | 5/1941 | Barton | |
| D238,434 | S | 1/1976 | Berlin | |
| 4,902,260 | A * | 2/1990 | Im | 446/154 |
| 5,628,667 | A * | 5/1997 | Levi | 446/278 |
| 6,461,218 | B1 * | 10/2002 | Mullaney et al. | 446/330 |
| 7,387,179 | B2 * | 6/2008 | Anhalt et al. | 180/9.1 |
| 7,479,055 | B2 * | 1/2009 | Saeki | 446/454 |
| D624,974 | S | 10/2010 | Taylor | |
| 2009/0137186 | A1 * | 5/2009 | Willett et al. | 446/368 |

OTHER PUBLICATIONS

International Preliminary Report on Patentability dated Aug. 2, 2011 from PCT Application No. PCT/GB2010/050156 filed Feb. 1, 2010 (6 pages).

Office Action dated May 6, 2010 from U.S. Appl. No. 29/341,120, filed Jul. 30, 2009 (5 pages).

Notice of Allowance dated Jul. 14, 2010 from U.S. Appl. No. 29/341,120, filed Jul. 30, 2009 (4 pages).

Issue Notification dated Sep. 15, 2010 from U.S. Appl. No. 29/341,120, filed Jul. 30, 2009 (1 page).

* cited by examiner

TOY SNAKE

The present invention relates to the field of toys and in particular a toy snake comprising a motor unit, the operation of motor unit providing a means for propelling the toy snake across a surface.

Toy snakes are known in the art. For example, it is known to make single piece rubber moulded snakes. Alternatively, toy snakes have been made from a number of plastic body segments that are longitudinally arranged between a head and tail section and are pivotally attached to their adjacent segments. Manual movement of the head or tail, for example by a child, results in the body segments pivoting relative to each other which is intended to mimic the natural movement of a snake. In practice the results are disappointing and none of the toy snakes provide a realistic reproduction of the natural movement of a snake.

It is therefore an object of an aspect of the present invention to obviate or at least mitigate the foregoing disadvantages of the toy snakes known in the art.

SUMMARY OF INVENTION

According to a first aspect of the present invention there is provided a toy snake the toy snake comprising a head that is pivotally mounted to a tail and a motor unit located in the head, wherein the motor unit provides a means for propelling the snake across a surface.

Incorporation of the motor unit allows the snake to better reproduce the natural movement of a snake as it moves across surface. The surface may be either land or water.

Most preferably the snake further comprises a body pivotally mounted between the head and the tail. Preferably the body comprises two or more pivotally attached body sections.

Most preferably the snake further comprises a tongue that extends out from the head.

Preferably the motor unit is connected to the tongue so as to move the tongue relative to the head during movement of the snake.

Most preferably the motor unit comprises at least two independently driven wheels located towards opposite sides of the head.

Preferably the motor unit introduces an automated periodic oscillation between the operation of the independently driven wheels. This automated periodic oscillation provides the snake with a realistic rippling effect as the toy moves across the surface Optionally the independently driven wheels are provided with serrated grips. This makes the snake particularly suited for moving across land. Alternatively, the independently driven wheels comprise water wheels. This makes the snake particularly suited for moving across the surface of a body of water.

Optionally one or more of the body sections comprise one or more wheels. Such wheels assist the movement of the snake over land.

Optional the body comprises a central body section, nine pivotally attached body sections located between the head and the central body section and nine pivotally attached body sections located between the central body section and the tail.

Preferably the head further comprises a power source electrically connected to the motor unit.

Preferably the head further comprises an electrical control circuit employed to control the motor unit.

The electrical control circuit may allow for the automated periodic oscillation between the operation of the independently driven wheels to be overridden. When the automated periodic oscillation between the operation of the independently driven wheels is overridden the propagation of the toy snake may be deviated from a substantially linear direction.

Optionally the electrical control circuit comprises a receiver so as to allow the snake to be operated by remote control.

Optionally the tail comprises a plurality of beads.

According to a second aspect of the present invention there is provided a toy snake the toy snake comprising a head that is pivotally mounted to a tail and a motor unit located in the head, the motor unit comprises at least two independently driven wheels located towards opposite sides of the head, wherein in the motor unit introduces an automated periodic oscillation between the operation of the independently driven wheels so as to provide a means for propelling the snake across a surface.

Embodiments of the second aspect of the invention may comprise features to implement the preferred or optional features of the first aspect of the invention or vice versa.

BRIEF DESCRIPTION OF DRAWINGS

Aspects and advantages of the present invention will become apparent upon reading the following detailed description and upon reference to the following drawings in which.

DETAILED DESCRIPTION

Figure 1:
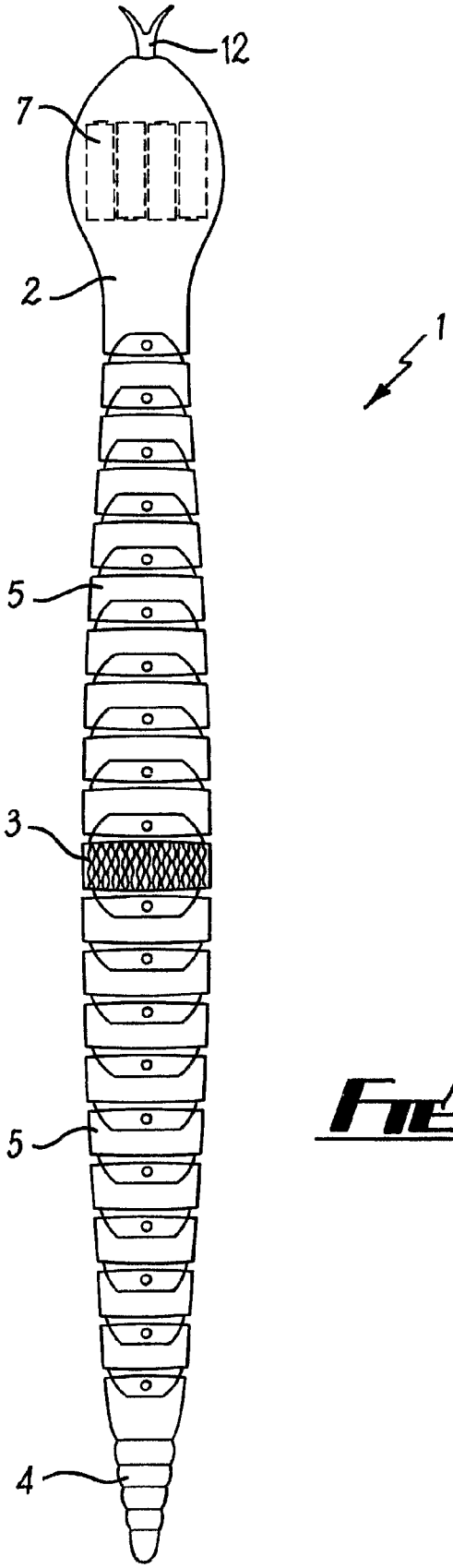
FIG. 1 presents a schematic top view of a toy snake in accordance with an embodiment of the present invention.
Figure 2:
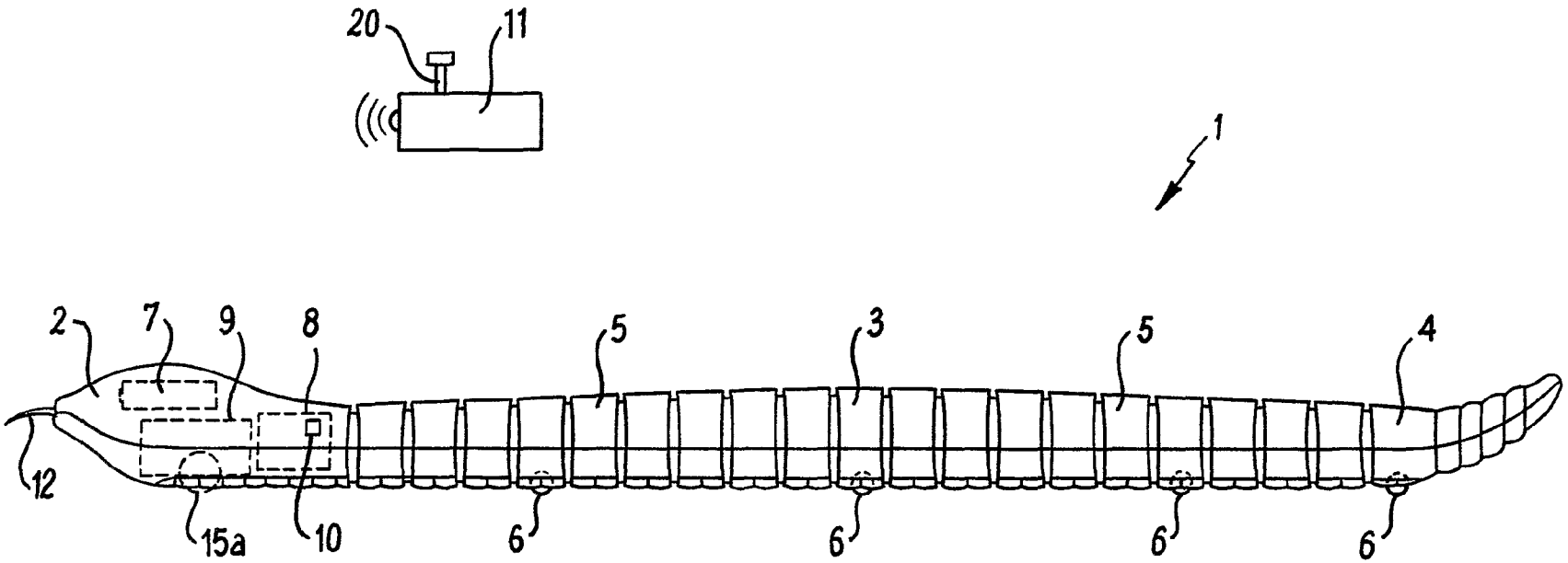
FIG. 2 presents a schematic side view of the toy snake of FIG. 1.
Figure 3:
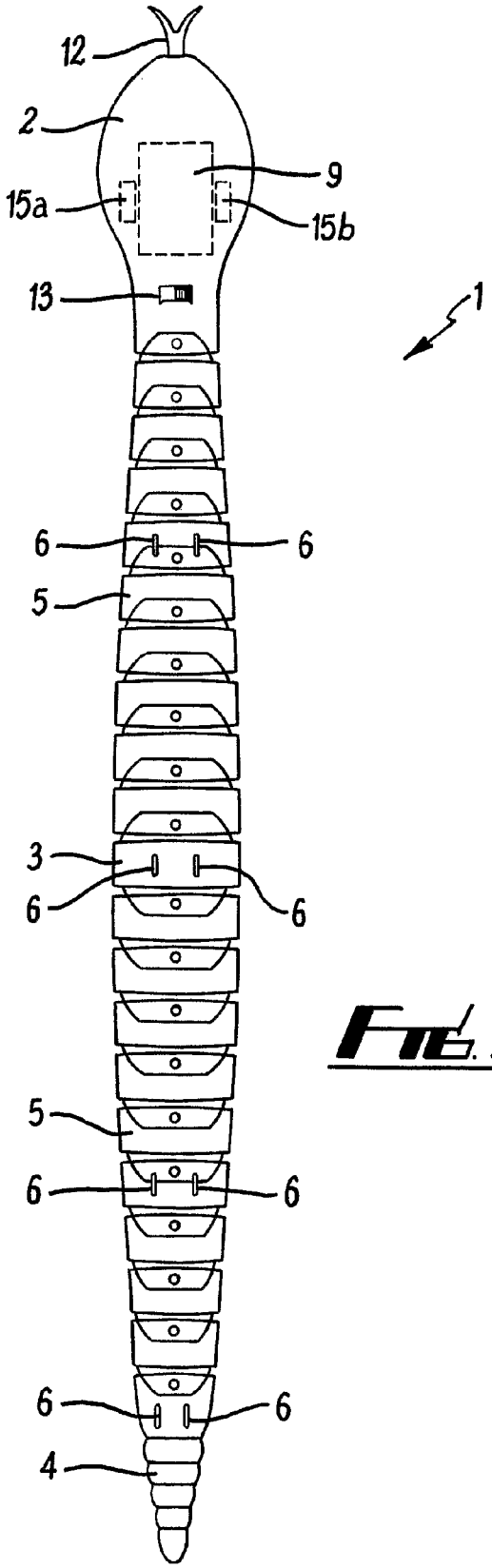
FIG. 3 presents a schematic bottom view of the toy snake of FIG. 1.

FIGS. 1 to 3 present a schematic top, side and bottom view, respectively, of a toy snake 1 in accordance with an embodiment of the present invention. The toy snake 1 can be seen to comprise a head 2, a central body section 3 and a tail 4. Nine body sections 5 are longitudinally arranged between the head 2 and the central body section 3, each body section 5 being pivotally attached to their adjacent segments. The first and ninth body sections 5 are also pivotally attached to the head 2 and central body section 3, respectively. In a similar manner, a further nine body sections 5 are longitudinally arranged between the central body section 3 and the tail 4, each body section 5 again being pivotally attached to their adjacent segments. The tenth and eighteenth body sections 5 are also pivotally attached to the central body section 3 and the tail 4, respectively.

The top surface of the head 2, central body section 3, body sections 5 and tail 4 preferably comprise a representation of snake skin so as to increase the authentic look of the snake 1. This representation may be applied by engraving, embossing or printing on the top surface of these sections.

In the presently described embodiment, a set of free spinning wheels 6 are located on the bottom surface of the fourth and fifteenth body sections 5, the central body section 3 and the tail 4. These wheels 6 assist the movement of the snake 1 across a surface, as described in further detail below.

The tail 4 also comprises a plurality of beads which rattle during the movement of the snake 1 across a surface, thus further adding to the authenticity of the snake 1.

Located within the head 2 is a power source 7 in the form of four battery cells, a printed circuit board (PCB) 8 upon which are mounted the control electronics for the snake 1, and a motor unit 9. It is preferable for the PCB to comprise a receiver 10 such that the snake 1 can be controlled via a remote control unit 11. A tongue 12 is attached to the motor unit 9 and extends from the head 2. On the bottom surface of the head 2 is located a switch 13 used to connect and disconnect the power source 7 and the motor unit 9.

Figure 4:
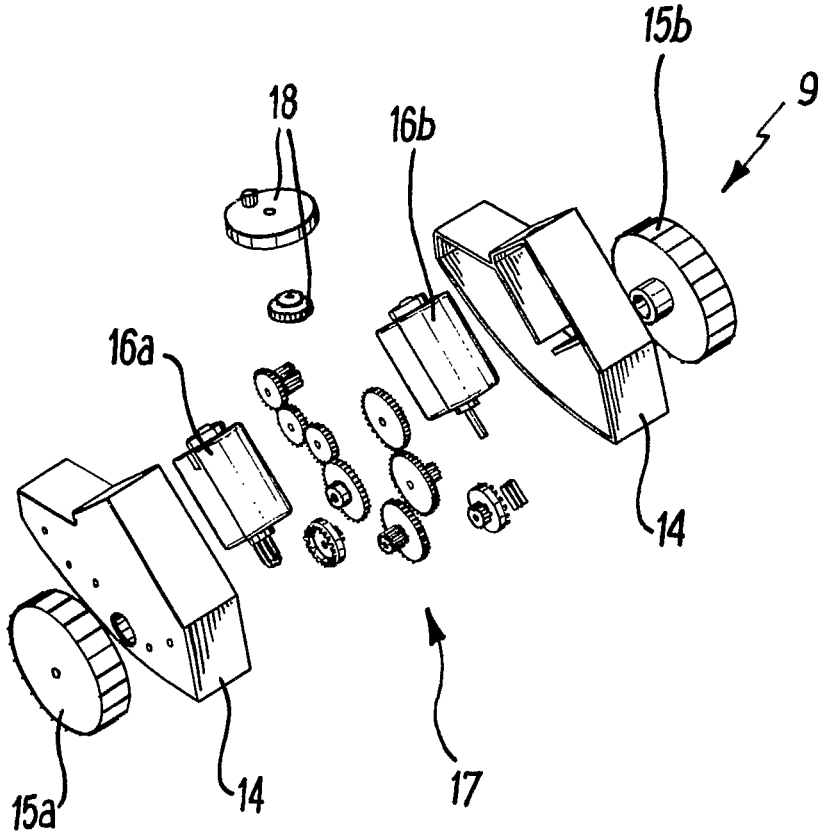
FIG. 4 presents an exploded view of a motor unit of the toy snake of FIG. 1.

Detail of the motor unit 9 is provided within the exploded view of FIG. 4. The motor unit 9 comprises a housing 14 located external of which are two wheels 15*a* and 15*b*. The wheels 15*a* and 15*b* are provided with serrated grips so as to increase the friction between the wheels 15*a* and 15*b* and the surface over which the snake 1 is to move. Two electric motors, 16*a* and 16*b*, are located within housing 14, each connected via a gearing mechanism 17 to just one of the wheels 15*a* and 15*b* so as to provide a means for independently driving each of the wheels 15*a* and 15*b*. A tongue gearing mechanism 18 is employed to connect the electric motor 16*a* to the tongue 12. As a result, when the electric motor 16*a* drives wheel 15*a* it also acts to move the tongue 12 in and out of the head 2.

Figure 5:
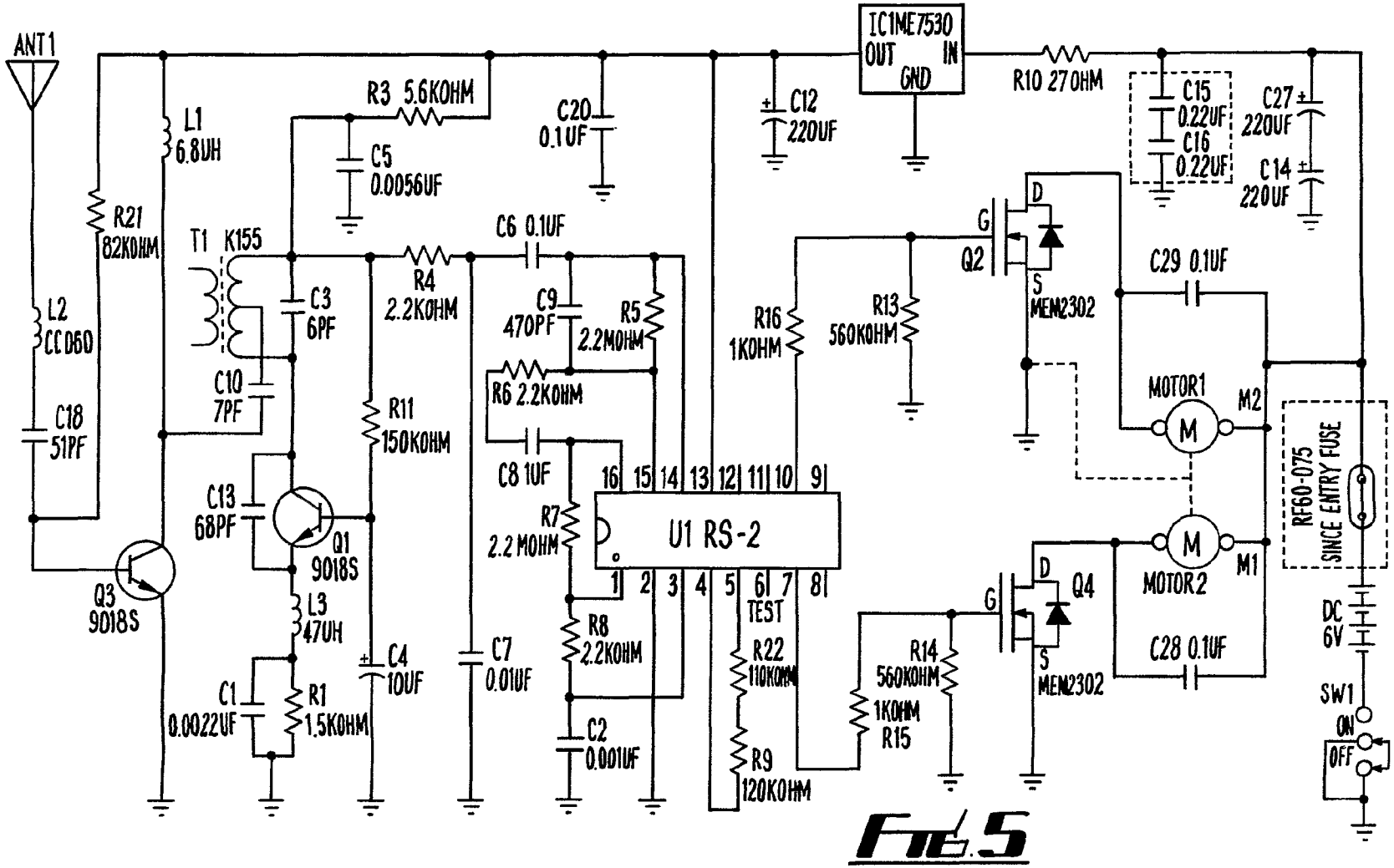
FIG. 5 presents a circuit diagram of control electronics employed with the motor unit.
Figure 6:
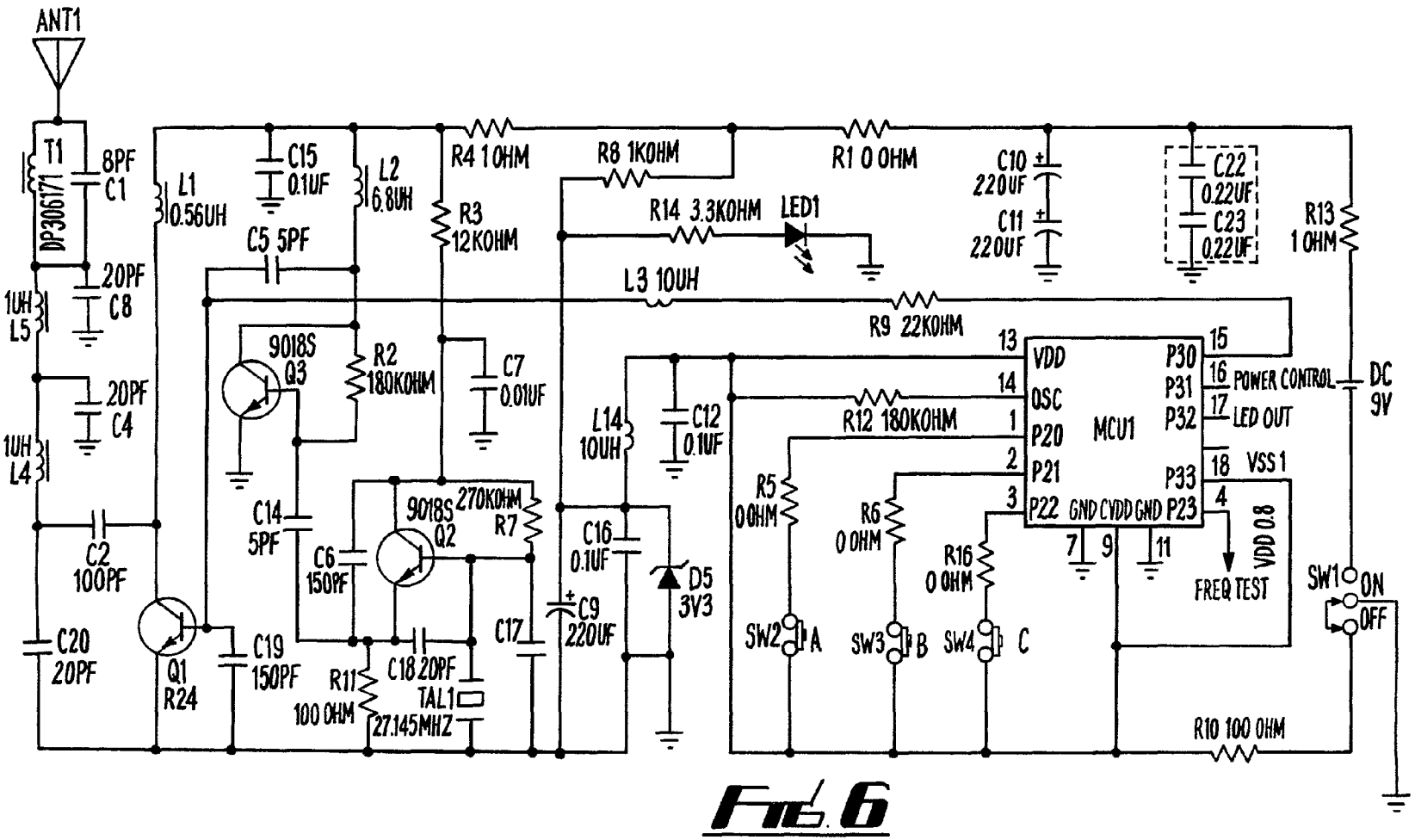
FIG. 6 presents a circuit diagram of a remote control unit for the toy snake of FIG. 1.

A circuit diagram of control electronics 19 employed within the motor unit 9 is provided within FIG. 5. A circuit diagram of the corresponding remote control unit 11 is provided in FIG. 6.

Figure 7A:
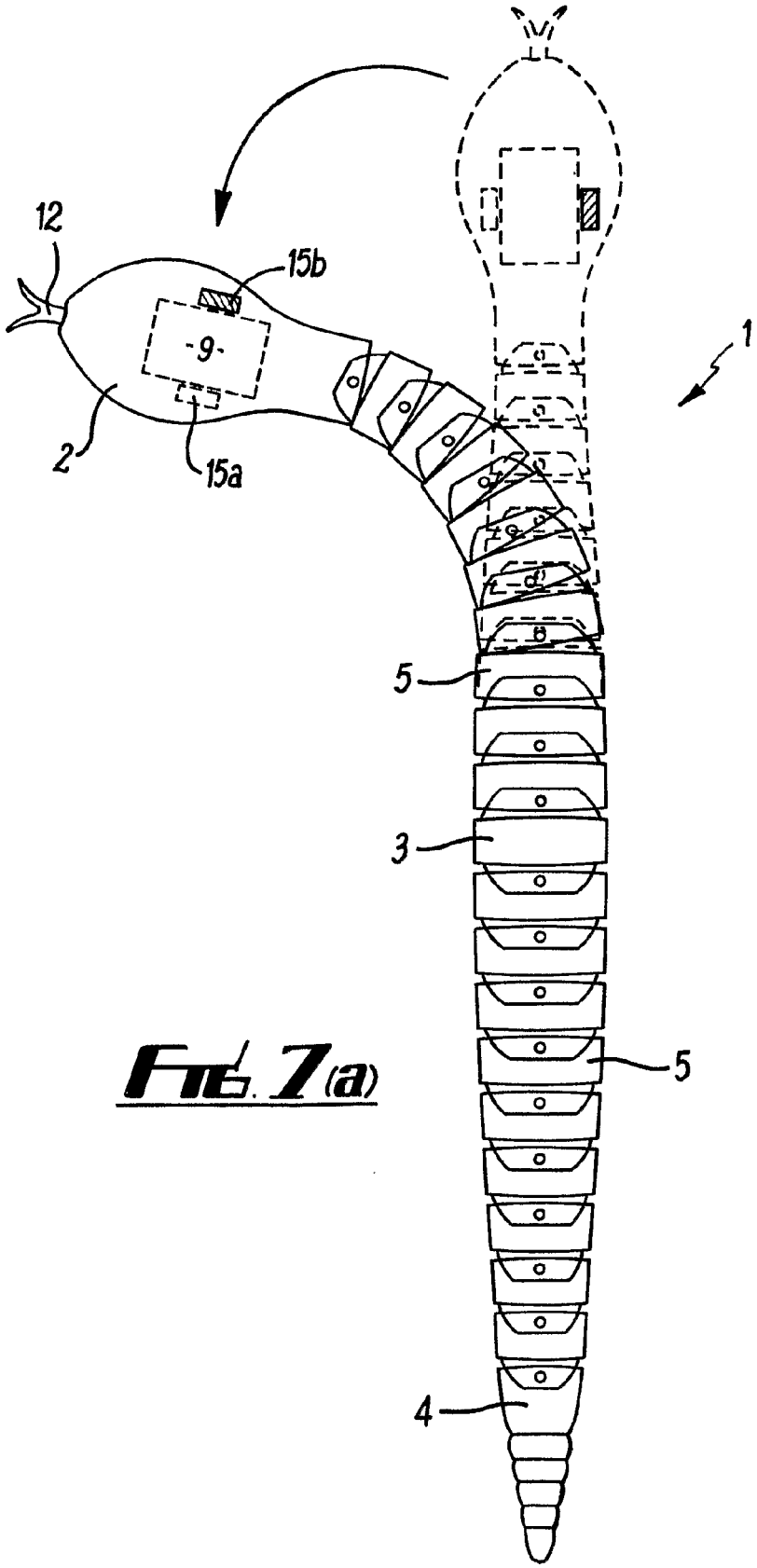
FIG. 7 presents: a) a first; b) a second; and c) a third, schematic action view of the snake of FIG. 1 so as to illustrate how it moves across a surface.
Figure 7B:
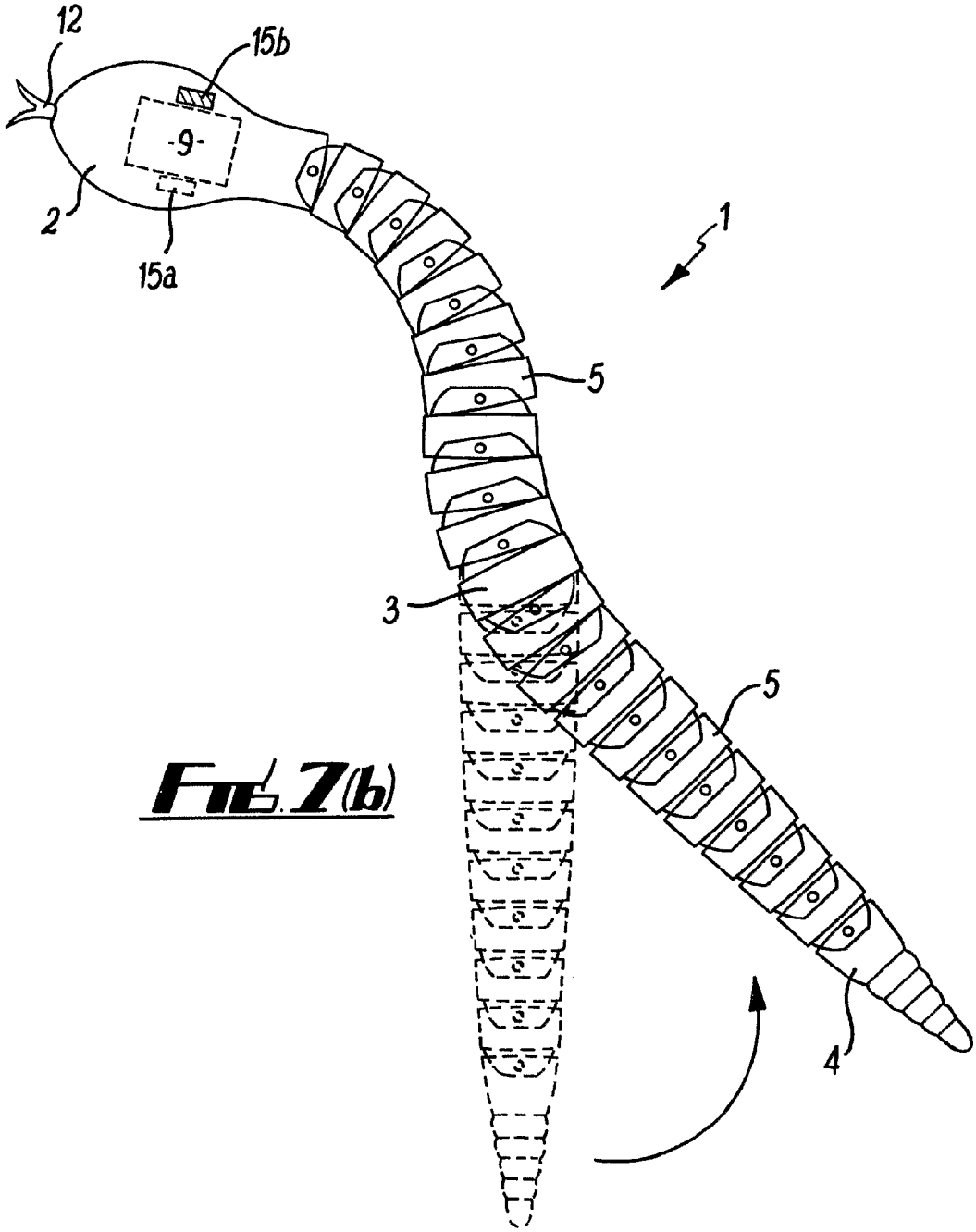
Figure 7C:
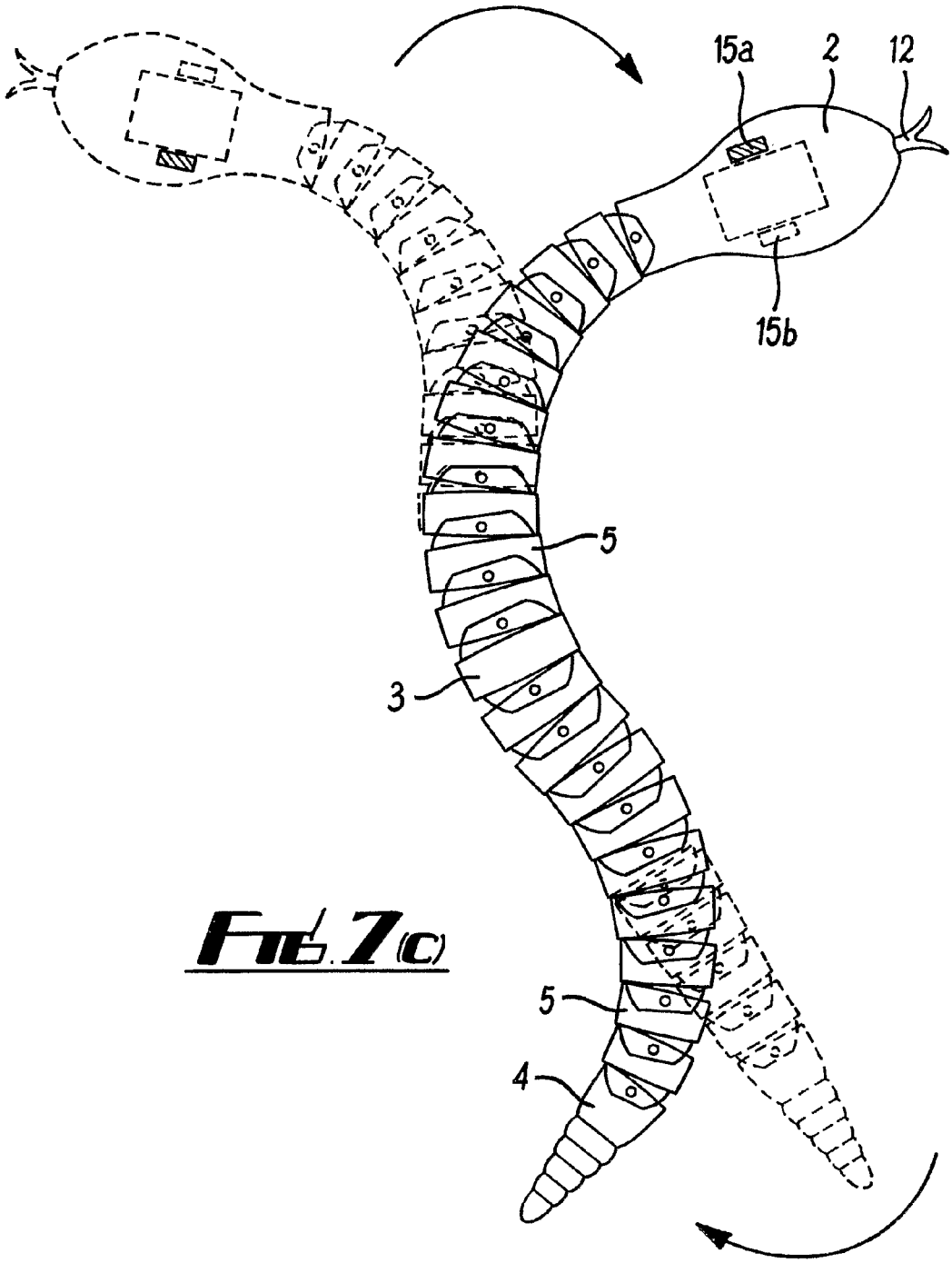

With reference to FIG. 7 there now follows an explanation of how the motor unit 9 acts to move the snake 1 across a surface. When the switch 13 is in the on position the power source 7 is connected to the motor unit 9 and the snake 1 is ready for use. On activating a forward button or joystick mechanism 20 on the remote control unit 11 the control electronics 19 act to provide power to electric motor 16*b* so that wheel 15*b* begins to rotate independently of wheel 15*a*.

As shown in FIG. 7(*a*) the effect of this is to cause the snake 1 to move forward while the head 2 turns to the left. The turning of the head 2 causes a ripple to flow down the body, as presented schematically in FIG. 7(*b*). After a short period of time, for example one second, the control electronics 19 act to power down electric motor 16*b* and to power up electric motor 16*a*. At this stage wheel 15*a* begins to rotate independently of wheel 15*b* which now stops rotating. As a result, the snake 1 continues to move forward with the head 2 now turning through its original central location towards the right, as presented schematically in FIG. 7(*c*). This oscillation of the powering up and powering down the electric motors 16*a* and 16*a* causes corresponding ripples to flow down through the body as the snake 1 moves over a surface in a substantially linear direction.

It is the combined forward movement and the body rippling effect that allows the snake 1 to reproduce a highly realistic natural movement of a snake. The realistic nature of the snake 1 is further added to by the in and out movement of the tongue 12 as the snake 1 slithers across the surface and the rattling sound produced by the tail 4.

The control electronics 19 may also allow the toy snake to be temporarily deviated from the above described substantially linear propagation. When the joystick mechanism 20 of remote control unit 11 is pushed to one side the oscillatory driving of the wheels 15*a* and 15*b* is overridden such that only one of the wheels is powered at any one time e.g. if the joystick mechanism 20 is pushed left wheel 15*a* is powered and the toy snake will turn to the left. In a similar manner, if the joystick mechanism 20 is pushed right wheel 15*b* is powered and the toy snake will turn to the right. When the joystick mechanism 20 is returned to the forward direction the oscillatory powering of the wheels 15*a* and 15*b* is resumed.

The above described snake may be adapted so as to provide a toy snake that moves across the surface of water. In order to achieve this water snake embodiment the wheels in the head are simply required to be adapted so as to function as water wheels. The wheels within the body sections and the tail may then be removed.

It will be appreciated that a number of alternatives exists to the above described embodiments. For example, the length of the body of the snake may be varied so as to decrease or increase the overall length of the snake, as desired. Indeed the head and tail could be pivotally connected directly to each other, although this would detract from the above described rippling effect.

With larger snakes it may prove beneficial to increase the number of drive wheels on each side of the head. The rippling effect is still achieved as long as wheels on the same side of the head are powered up and down at the same time. In a similar manner, the number of body sections comprising free rotating wheels may wish to be increased or decreased in accordance with the length of the snake.

The described rippling effect may also be changed by varying the period of oscillation of the powering up and down of the electric motors.

In a further alternative embodiment, the snake may commence operation upon the switch being moved to the on position, thus removing the need for a receiver and the remote control unit.

It is envisaged that a speaker may also be incorporated within the control electronics so that the snake may appear to make a hissing sound as it moves.

As an alternative to battery cells, the snake may employ a solar panel to generate the required power.

The foregoing description of the invention has been presented for purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention as defined by the appended claims.

The invention claimed is:

1. A toy snake comprising a head that is pivotally mounted to a tail and a motor system located in the head, the motor system comprises at least two independently driven wheels located towards opposite sides of the head, wherein the motor system, in response to a first signal, causes an automated periodic oscillation between the operation of the independently driven wheels so as to provide a means for propelling the snake across a surface wherein said independently driven wheels rotate simultaneously and at a different rate during at least a portion of the automated periodic oscillation, wherein the motor system is configured to override said automated periodic oscillation in response to a second signal.

2. A toy snake as claimed in claim 1 wherein the snake further comprises a body pivotally mounted between the head and the tail.

3. A toy snake as claimed in claim 2 wherein the body comprises two or more pivotally attached body sections.

4. A toy snake as claimed in claim 3 wherein one or more of the body sections comprise one or more wheels.

5. A toy snake as claimed in claim 2 wherein the body comprises a central body section, nine pivotally attached body sections located between the head and the central body section and nine pivotally attached body sections located between the central body section and the tail.

6. A toy snake as claimed in claim 1 wherein the snake further comprises a tongue that extends out from the head.

7. A toy snake as claimed in claim 4 wherein the motor system is connected to the tongue so as to move the tongue relative to the head during movement of the snake.

8. A toy snake as claimed in claim 1 wherein the independently driven wheels are provided with serrated grips.

9. A toy snake as claimed in claim 1 wherein the independently driven wheels comprise water wheels.

10. A toy snake as claimed in claim 1 wherein the head further comprises a power source electrically connected to the motor system.

11. A toy snake as claimed in claim 1 wherein the head further comprises an electrical control circuit employed to control the motor system.

12. A toy snake as claimed in claim 11 wherein the electrical control circuit provides a means for overriding the automated periodic oscillation between the operation of the independently driven wheels.

13. A toy snake as claimed in claim 11 wherein the electrical control circuit comprises a receiver so as to allow the snake to be operated by remote control.

14. A toy snake as claimed in claim 1 wherein the tail comprises a plurality of beads.

15. A toy as claimed in claim 1, wherein the motor unit introduces the automated periodic oscillation without remote input and wherein the automated periodic oscillation is overridden in response to an input signal.

* * * * *